US007647933B2

(12) United States Patent
Morgenstern et al.

(10) Patent No.: US 7,647,933 B2
(45) Date of Patent: Jan. 19, 2010

(54) HAIR COLORING APPLICATOR

(76) Inventors: Martin Alejandro Morgenstern, Amenabar 1414 1er piso, Buenos Aires (AR) 1426; Dalia Khaty de Morgenstern, Amenabar 1414 1er piso, Buenos Aires (AR) 1426

( * ) Notice: Subject to any disclaimer, the term of this patent is extended or adjusted under 35 U.S.C. 154(b) by 570 days.

(21) Appl. No.: 11/393,159

(22) Filed: Mar. 29, 2006

(65) Prior Publication Data

US 2007/0235053 A1 Oct. 11, 2007

(51) Int. Cl.
*A45D 24/22* (2006.01)

(52) U.S. Cl. ..... 132/114

(58) Field of Classification Search ..... 132/208, 132/108–116, 120, 901; 401/22, 24, 26, 401/35, 38, 39

See application file for complete search history.

(56) References Cited

U.S. PATENT DOCUMENTS

| | | | | | |
|---|---|---|---|---|---|
| 952,491 | A | * | 3/1910 | Youngs | 132/159 |
| 2,616,120 | A | * | 11/1952 | Erling | 15/402 |
| 2,672,875 | A | * | 3/1954 | Kovacs | 132/112 |
| 2,865,383 | A | * | 12/1958 | Kaley | 132/213 |
| 3,059,652 | A | * | 10/1962 | Thomas | 132/112 |
| 3,209,386 | A | * | 10/1965 | Weber | 15/344 |
| 3,424,176 | A | * | 1/1969 | Hale | 132/112 |
| 4,779,572 | A | * | 10/1988 | Freulon | 119/604 |
| 4,966,175 | A | * | 10/1990 | Kimura et al. | 132/112 |
| 4,993,437 | A | * | 2/1991 | Kimura et al. | 132/112 |
| 5,125,423 | A | * | 6/1992 | Butterbrodt | 132/112 |
| 5,146,936 | A | | 9/1992 | Ng | |
| 5,289,835 | A | | 3/1994 | Harlan et al. | |
| 5,333,627 | A | | 8/1994 | Mehringer et al. | |
| D401,380 | S | | 11/1998 | Steen et al. | |
| 5,937,865 | A | | 8/1999 | Dhaliwal | |
| 6,009,881 | A | * | 1/2000 | Baudin et al. | 132/112 |
| 6,053,177 | A | | 4/2000 | Sofer | |
| 6,062,230 | A | | 5/2000 | Kajgana | |
| 6,145,513 | A | | 11/2000 | Chu et al. | |
| D442,331 | S | | 5/2001 | Pannozzo et al. | |
| 6,286,518 | B1 | | 9/2001 | Laporte | |
| 6,460,546 | B1 | | 10/2002 | Sofer | |
| 6,688,314 | B1 | * | 2/2004 | Hoeffkes et al. | 132/114 |
| 2004/0221864 | A1 | | 11/2004 | Capristo | |
| 2005/0092340 | A1 | | 5/2005 | Rijskamp | |
| 2005/0211261 | A1 | | 9/2005 | Capristo | |

FOREIGN PATENT DOCUMENTS

| | | |
|---|---|---|
| JP | 9308519 | 12/1997 |

* cited by examiner

*Primary Examiner*—Robyn Doan
*Assistant Examiner*—Rachel R Steitz
(74) *Attorney, Agent, or Firm*—Eric Karich

(57) ABSTRACT

A hair coloring applicator has an applicator body having a top surface and a bottom surface. A neck receiving bore in the bottom surface is adapted to engage a neck of a container. The hair coloring applicator further includes a plurality of solution application prongs, a plurality of comb elements, and a plurality of distribution brushes that extend upwardly from the top surface. A plurality of solution application ducts communicate between the neck receiving bore and a proximal ends of each of the plurality of solution application prongs.

6 Claims, 2 Drawing Sheets

HAIR COLORING APPLICATOR

BACKGROUND OF THE INVENTION

1. Field of the Invention

This invention relates generally to applicators for applying a fluid, and more particularly to a hair coloring applicator for coloring a user's hair.

2. Description of Related Art

The prior art includes many devices for applying a hair coloring agent to a user's hair. In common practice, the coloring agent is mixed with a hydrogen peroxide containing compound, applied to a comb, and combed into the user's hair. Other devices include mixing chambers with injector elements for injecting the mixture into the user's hair, or onto a comb. Most of the prior art devices commonly used in the industry cannot be used by the user to apply the agent to his or her own hair, but require the assistance of a professional.

Other specialty devices have also been developed to assist a user in applying the agent to his or her own hair. However, these devices are often complicated, battery powered devices that are difficult to use. Rijskamp, U.S. 2005/0092340, teaches a battery powered device for applying a hair dye to a user's hair. The device includes a base part, an applicator which is connected to an additive reservoir, and has at least one outlet opening for applying additive to the hair during operation. The applicator includes a hair parting element for parting the hair during operation. The hair parting element has a substantially wedge-shaped cross-section with a tip extending practically in the operating direction. The outlet opening is positioned behind the tip, as viewed in the operating direction.

The Rijskamp patent application is generally similar in both structure and function to the present application; however, there are important differences between the two devices. The Rijskamp device includes a wedge-shaped hair parting element, rather than the comb elements used for grasping the hair in the present invention. There is also a difference in the structure of the elements that trail the injection conduit, with the present applicator utilizing a brush structure rather than the prongs used in the Rijskamp device. Furthermore, the Rijskamp device includes an internal reservoir for containing the hair coloring solution, and an electric motor for dispensing the hair coloring solution. Not only does this require the device to be filled and periodically emptied and cleaned, it also requires a motor for dispensing the solution, and batteries to power the motor. The present invention requires none of these elements, but utilizes the container of the cleaning solution both for storage of the solution and for powering the dispensing of the solution.

Kajgana, U.S. Pat. No. 6,062,230, teaches a tint brush with a color distributor, the brush being adapted to be screwed onto a connection pipe with a main tinter body. A free flow of hair dye mixture from the container is enabled by squeezing the container or by using a pump provided in the container in an alternative embodiment. A collector area defined in the main tinter body collects dye mixture wherefrom the dye mixture is distributed with the aid of a flow regulator and a plurality of radial exit bores which define, on their ends, funnel-like or shaped openings that open in tangent with a set of bristles connected to the tinter body. The flow regulator is suitably grooved so that the rate of dye mixture flowing through the main tinter body can be regulated from a minimum to a maximum amount by turning the flow regulator by 90 degrees.

Laporte, U.S. Pat. No. 6,286,518, teaches another device for applying dye to a user's hair. Similar to the Rijskamp device, the Laporte device includes a reservoir and a dispensing head, equipped with at least one row of application teeth, this head being connected to the reservoir by at least one channel for conveying the product to the base of the teeth. The head comprises at least one row of retention teeth extending along each row of application teeth and located at a distance from the latter, these teeth being shorter than the teeth; the space between one row of application teeth and an adjacent row of retention teeth, and the spaces between the teeth in these two rows, are such that they permit the product to be retained in them so that said space located between one row of application teeth and an adjacent row of retention teeth forms an intermediate product reservoir capable of receiving and temporarily retaining this product. Similar devices are shown in Sofer, U.S. Pat. No. 6,053,177, Sofer, U.S. Pat. No. 6,460,546, and Dhaliwal, U.S. Pat. No. 5,937,865.

Various devices that inject dye adjacent a brush-type element are shown in Harlan, et al., U.S. Pat. No. 5,289,835, Mehringer, et al., U.S. Pat. No. 5,333,627, Capristo, U.S. 2005/0211261, and Capristo, U.S. 2004/0221864. Other patents of interest include Ng, U.S. Pat. No. 5,146,936, Chu, et al., U.S. Pat. No. 6,145,513, Seen, U.S. D401,380, Pannozzo, et al., U.S. D442,331, and Seiichi, et al., JP9308519. All of the above-described references are hereby incorporated by reference in full.

The prior art teaches various methods and devices for dispensing a hair coloring solution. However, the prior art does not teach the particular combination of elements and features used in the present invention, particularly the combination of comb elements for grasping the user's hair, injector prongs and solution application ducts for injecting the hair coloring solution, and brush elements for brushing the hair coloring solution through the user's hair. Furthermore, the prior art does not teach utilizing the container of the coloring solution for dispensing the coloring solution into the user's hair. The present invention fulfills these needs and provides further related advantages as described in the following summary.

SUMMARY OF THE INVENTION

The present invention teaches certain benefits in construction and use which give rise to the objectives described below.

The present invention provides a hair coloring applicator for coloring a user's hair. The hair coloring applicator is adapted to be used in conjunction with a container of hair coloring solution. The hair coloring applicator includes an applicator body having a top surface and a bottom surface. A neck receiving bore in the bottom surface is adapted to engage a neck of the container. The hair coloring applicator includes a plurality of solution application prongs, a plurality of comb elements, and a plurality of distribution brushes. The plurality of solution application prongs extend upwardly from the top surface to a proximal end. A plurality of solution application ducts communicate between the neck receiving bore and the proximal ends of each of the plurality of solution application prongs. The plurality of comb elements extend upwardly from the top surface in proximity to the plurality of solution application prongs. The plurality of distribution brushes each have a plurality of bristles extending upwardly from the top surface in proximity to one of the plurality of solution application prongs.

A primary objective of the present invention is to provide a hair coloring applicator having advantages not taught by the prior art.

Another objective is to provide a hair coloring applicator that includes, in a linear arrangement, a combination of combination of comb elements, injector prongs, and brush elements that together function to grip and position the user's hair, inject the hair coloring solution, and then spread the hair coloring solution through the user's hair.

A further objective is to provide a hair coloring applicator that utilizes the container of the cleaning solution both for storage of the solution and for powering the dispensing of the solution.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings.

DETAILED DESCRIPTION OF THE INVENTION

The above-described drawing figures illustrate the invention, a hair coloring applicator 10 for applying a hair coloring solution 12 to a user's hair 14.

Figure 1:
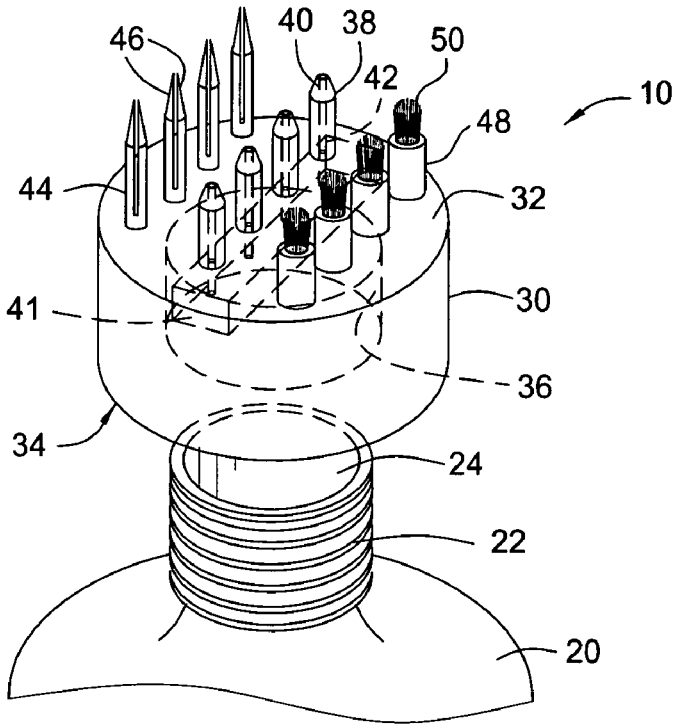
FIG. 1 is an exploded perspective view of a hair coloring applicator according to a preferred embodiment of the present invention.

As shown in FIG. 1, the hair coloring applicator 10 is adapted to be used in conjunction with a container 20 of the hair coloring solution 12. The container 20 has a neck 22 with an opening 24 for dispensing the hair coloring solution 12. The hair coloring applicator 10 is adapted to be mounted on a neck 22 of the container 20 so that the hair coloring solution 12 can be dispensed directly from the container 20, through the hair coloring applicator 10, into the user's hair 14.

Figure 2:
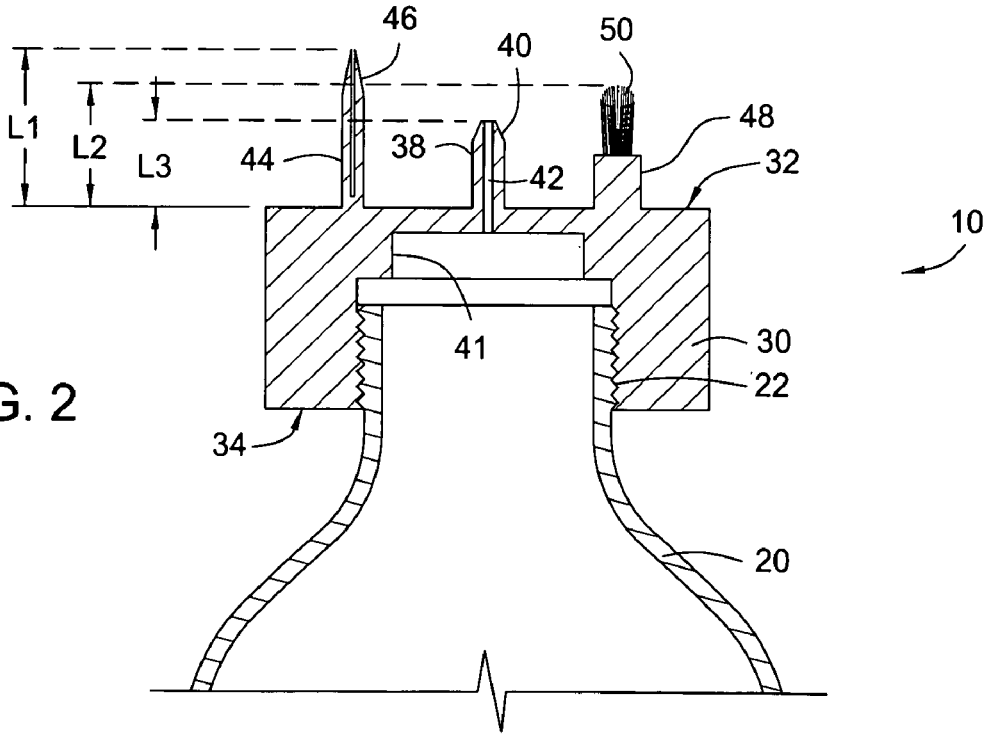
FIG. 2 is a sectional view thereof taken illustrating a compression chamber, one of the plurality of solution application prongs, one of the plurality of comb elements, and one of the plurality of distribution brushes.

As shown in FIGS. 1 and 2, the hair coloring applicator 10 includes an applicator body 30 having a top surface 32 and a bottom surface 34. The applicator body 30 includes a neck receiving bore 36 in the bottom surface 34 for engaging the neck 22 of the container 20. The neck receiving bore 36 is preferably internally threaded (not shown) for threadedly engaging external threads of the neck 22 of the container 20; however, alternative methods of engagement, including snap/frictional fits, or alternative forms of interlocking and/or engaging are also anticipated, and should be considered within the scope of the present invention, as claimed.

Figure 3:
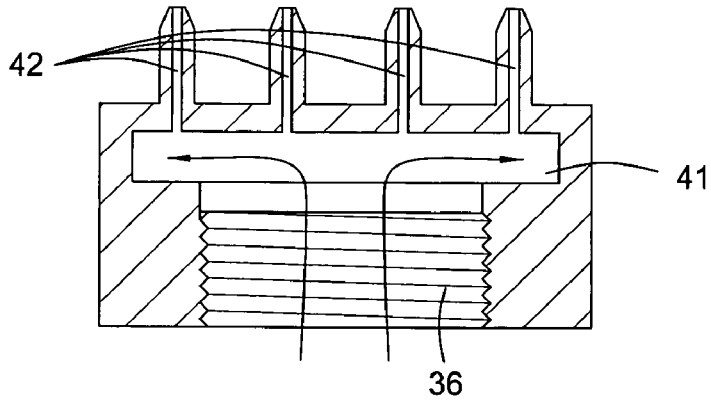
FIG. 3 is a sectional view of the hair coloring applicator illustrating all of the plurality of solution application prongs and the compression chamber.

As shown in FIGS. 1-4, in the preferred embodiment, the hair coloring applicator 10 includes a compression chamber 41 that is in fluid communication with the neck receiving bore 36. When the container 20 is compressed, as described below, the hair coloring solution 12 is forced into the compression chamber 41, from where it is dispensed into the user's hair (illustrated in FIG. 3 as reference number 14) through a plurality of solution application ducts 42, as described below. The compression chamber 41 is important because it functions to equalize the pressure of the hair coloring solution 12 between all of the plurality of solution application ducts 42, as illustrated in FIG. 3.

As shown in FIGS. 1-4, a plurality of solution application prongs 38 extend upwardly from the top surface 32 to a proximal end 40. The plurality of solution application ducts 42 communicate between the compression chamber 41 and the proximal ends 40 of each of the plurality of solution application prongs 38. The plurality of solution application prongs 38 are each shaped to extend through the user's hair 14 to inject the hair coloring solution 12 into the roots 16 of the user's hair 14, adjacent the users scalp 18 (as shown in FIG. 3). The diameter of the solution application ducts 42, in conjunction with the equalizing effect of the compression chamber 41, is what controls the dose of the hair coloring solution 12 that is dispensed during use. The plurality of solution application prongs 38 are preferably formed of molded plastic, either as separate components that are attached to the applicator body 30, or integrally formed therewith.

Figure 4:
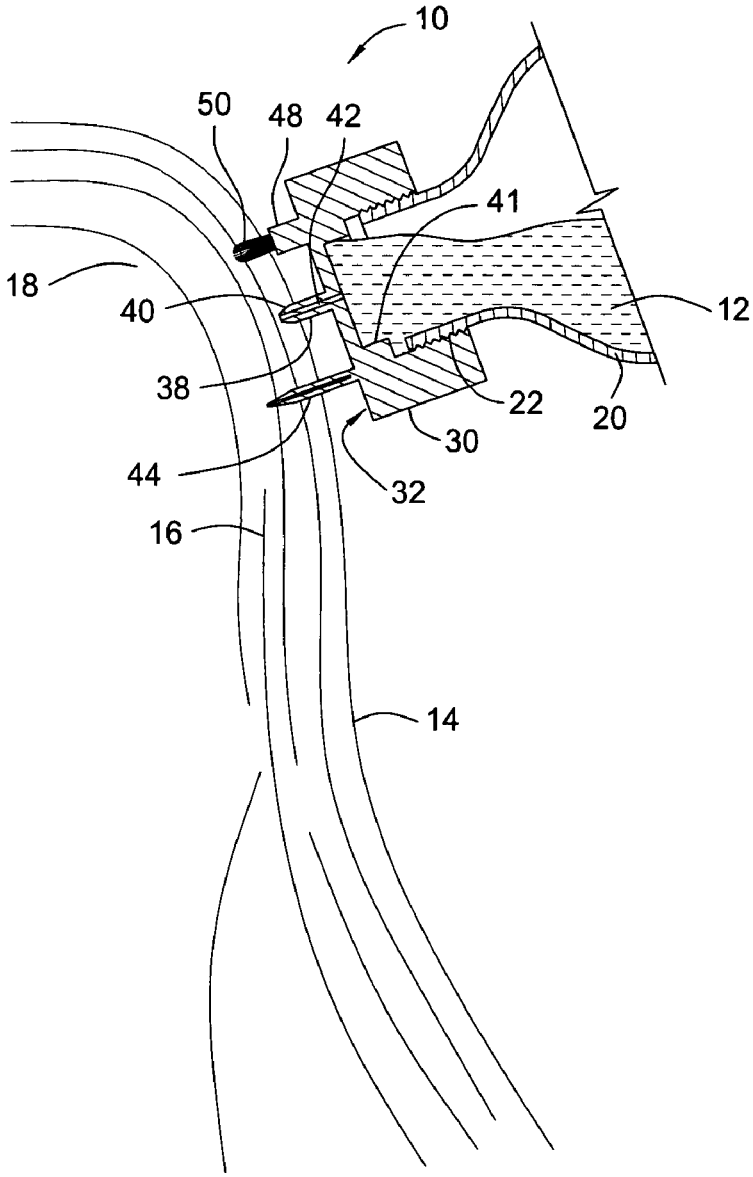
FIG. 4 is a perspective view illustrating the hair coloring applicator being used to dispense a hair coloring solution into a user's hair.

As shown in FIGS. 1 and 2, the hair coloring applicator 10 includes a plurality of comb elements 44 also extend upwardly from the top surface 32 of the applicator body 30. Each of the plurality of comb elements 44 preferably has at least two rigid fingers 46 adjacent each other, in proximity to one of the plurality of solution application prongs 38. As illustrated in FIG. 4, the plurality of comb elements 44 function to separate and grasp the user's hair 14, preparing the hair surface and its roots to receive the hair coloring solution 14 from the plurality of solution application prongs 38, as described in greater detail below. While one embodiment of the comb elements is shown herein, those skilled in the art will recognize that various alternative embodiments of the comb elements may also be used, and these alternative embodiments should be considered within the scope of the present invention.

As shown in FIGS. 1 and 2, the hair coloring applicator 10 further includes a plurality of distribution brushes 48. Each of the plurality of distribution brushes 48 preferably has a plurality of bristles 50 extending upwardly from the top surface 32 in proximity to one of the plurality of solution application prongs 38, opposite one of the plurality of comb elements 44. The plurality of distribution brushes 48 function to spread the hair coloring solution 12 through the user's hair 14 once it has been applied.

As shown in FIGS. 2 and 4, each of the plurality of distribution brushes 48 is positioned opposite a corresponding one of the plurality of comb elements 44, on either side of one of the plurality of solution application prongs 38, such that they together form a linear solution application and distribution arrangement.

For an efficient application process, the plurality of solution application prongs 38, the plurality of comb elements 44, and the plurality of distribution brushes 48 have different lengths with respect to one another. These different lengths allow the application process and sequences save work and reduce material losses, optimizing the coloring process.

In the preferred embodiment, as shown in FIG. 2, the plurality of comb elements 44 each have a length L1, the plurality of distribution brushes 48 each have a length L2, and the plurality of solution application prongs 38 each have a length L3, and L1 is greater than L2, and L2 is greater than L3. In the most preferred embodiment, L1 is approximately 2 cm., L2 is approximately 1.75 cm., and L3 is approximately 1.5 cm., although those skilled in the art may develop different lengths that are equally functional, and such alternative arrangements should be considered within the scope of the present invention.

In the preferred embodiment, there are four of the solution application prongs 38, comb elements 44, and distribution brushes 48; however, those skilled in the art may develop variations of the present invention with different numbers of these elements, and such alternative embodiments should be considered within the scope of the present invention, as claimed below.

The invention includes a method for applying a hair coloring solution 12 to a user's hair 14 using the hair coloring applicator 10 described above. Before applying the hair coloring solution 12, the two components of color coloring solution 12 should be mixed in the container 20. The hair coloring solution 12 usually contains both a hair coloring agent and a hydrogen peroxide containing solution. The original cap of the container 12 is replaced by the hair coloring applicator 10, described above. In the preferred embodiment, as described above, the hair coloring applicator 10 is threadedly attached to the neck 22 of the bottle, as shown in FIG. 1. In alternative embodiments, the hair coloring applicator 10 may be attached, mounted, or otherwise connected in any manner known in the art.

As shown in FIG. 4, the hair coloring applicator 10 is positioned through the user's hair 14 such that the plurality of solution application prongs 38 are adjacent to but spaced from the user's scalp 18 by the plurality of comb elements 44. The hair coloring applicator 10 is then moved in a linear direction while simultaneously injecting the hair coloring solution 12 into the user's hair 14 adjacent the user's scalp 18. In this manner, the plurality of comb elements 44 each comb the user's hair 14, gripping the hair and pulling it so that each of the plurality of solution application prongs 38 is able to be positioned adjacent the user's scalp 18, and so that the hair coloring solution 12 may be injected behind a corresponding one of the plurality of comb elements 44 into the roots 16 of the user's hair 14. In the preferred embodiment, the hair coloring solution 12 is injected by squeezing the container 20. Since the container 20 may be readily used to precisely control the flow of the hair coloring solution 12, the battery powered motor required in many of the prior art devices is not required, which results in an important improvement in the hair coloring applicator 10 due to the lower cost and easier maintenance of the applicator 10.

Finally, each of the plurality of distribution brushes 48 functions to spread the hair coloring solution 12 behind a corresponding one of the plurality of solution application prongs 38, through the user's hair 14. For purposes of this application, the term "plurality of bristles" (reference number 50) shall refer to a substantial number of resilient bristles, and shall exclude the small number of semi-rigid plastic fingers that have been used in prior art devices.

Certain terminology is used in the preceding description for convenience only, and is not limiting. Words such as "top," "bottom," and the like, designate directions in the drawings to which reference is made. The terminology used in this application is hereby defined to include not only the words described above, but also similar or equivalent words, and derivatives thereof. Additionally, the words "a," "an," and "one" are defined to include one or more of the referenced item unless specifically stated otherwise. Also, the terms "have," "include," "contain," and similar terms are defined to mean "comprising" unless specifically stated otherwise.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A hair coloring applicator for coloring a user's hair using a container of a hair coloring solution, the container having a neck with an opening, the hair coloring applicator comprising:

an applicator body having a top surface and a bottom surface;

a neck receiving bore in the bottom surface for engaging the neck of the container;

a plurality of solution application prongs extending upwardly from the top surface to a proximal end in a linear arrangement, each of the plurality of solution application prongs being laterally spaced from the other solution application prongs;

a plurality of solution application ducts communicating between the neck receiving bore and the proximal ends of each of the plurality of solution application prongs;

a plurality of comb elements adapted to frictionally grip the user's hair, each of the plurality of comb elements extending upwardly from the top surface in a linear arrangement, each of the plurality of comb elements being laterally spaced from the other comb elements; and a plurality of distribution brushes, each of the plurality of distribution brushes extending upwardly from the top surface in a linear arrangement, each of the plurality of distribution brushes being laterally spaced from the other comb elements, wherein each of the plurality of comb elements is in proximity to one of the plurality of solution application prongs, opposite one of the plurality of distribution brushes, such that each of the plurality of solution application prongs forms a linear solution application and distribution arrangement with one of the plurality of comb elements and one of the distribution brushes, and such that linear movement of the hair coloring applicator through the user's hair causes the plurality of comb elements to grip the user's hair so that the plurality of solution application prongs are positioned to inject the hair coloring solution into roots of the user's hair, and the plurality of distribution brushes spread the hair coloring solution through the user's hair.

2. The hair coloring applicator of claim 1, wherein each of the plurality of comb elements has at least two rigid fingers adjacent each other.

3. The hair coloring applicator of claim 1, further comprising a compression chamber between the neck receiving bore and the plurality of solution application ducts.

4. The hair coloring applicator of claim 1, wherein each of the plurality of distribution brushes includes a plurality of bristles extending upwardly from the top surface.

5. The hair coloring applicator of claim 1, wherein the plurality of comb elements each have a length L1, the plurality of distribution brushes each have a length L2, and the plurality of solution application prongs each have a length L3, and L1 is greater than L2, and L2 is greater than L3.

6. The hair coloring applicator of claim 1, wherein L1 is approximately 2 cm., L2 is approximately 1.75 cm., and L3 is approximately 1.5 cm.

* * * * *